US011075446B2

(12) United States Patent
Khripkov et al.

(10) Patent No.: US 11,075,446 B2
(45) Date of Patent: Jul. 27, 2021

(54) COMMUNICATION DEVICE

(71) Applicants: Huawei Technologies Co., Ltd., Shenzhen (CN); Alexander Khripkov, Helsinki (FI)

(72) Inventors: Alexander Khripkov, Helsinki (FI); Linsheng Li, Kista (SE); Ruiyuan Tian, Helsinki (FI)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 8 days.

(21) Appl. No.: 16/612,605

(22) PCT Filed: May 12, 2017

(86) PCT No.: PCT/EP2017/061429
§ 371 (c)(1),
(2) Date: Nov. 11, 2019

(87) PCT Pub. No.: WO2018/206116
PCT Pub. Date: Nov. 15, 2018

(65) Prior Publication Data

US 2020/0203804 A1 Jun. 25, 2020

(51) Int. Cl.
*H01Q 1/24* (2006.01)
*H01Q 5/307* (2015.01)
(Continued)

(52) U.S. Cl.
CPC ..... *H01Q 1/243* (2013.01); *H01Q 5/307* (2015.01); *H01Q 9/0485* (2013.01);
(Continued)

(58) Field of Classification Search
CPC ..... H01Q 1/243; H01Q 5/307; H01Q 9/0485; H01Q 13/10; H01Q 21/24; H01Q 21/28
(Continued)

(56) References Cited

U.S. PATENT DOCUMENTS 10,340,592 B2 * 7/2019 Nam ..... H01Q 21/28
10,355,344 B1 * 7/2019 Ruaro ..... H04B 1/40
(Continued)

FOREIGN PATENT DOCUMENTS

CN 101911383 A 12/2010
CN 105555069 A 5/2016
(Continued)

OTHER PUBLICATIONS

Machine Translation and Abstract of Japanese Publication No. JP2003318622, Nov. 7, 2003, 20 pages.
(Continued)

*Primary Examiner* — Jean B Jeanglaude
(74) *Attorney, Agent, or Firm* — Conley Rose, P.C.

(57) ABSTRACT

A communication device for wireless communication includes a housing having a front dielectric cover, a back dielectric cover and a metal frame circumferentially arranged between the front dielectric cover and the back dielectric cover. The metal frame forms a first antenna that is configured to radiate in a first set of frequency bands. The communication device further includes a circuit arranged inside the housing, where the circuit is electrically isolated from the metal frame and includes at least one first feed line coupled to the metal frame and configured to feed the first antenna with a first set of radio frequency signals in the first set of frequency bands. The communication device further includes a second antenna arranged inside the housing.

18 Claims, 6 Drawing Sheets

(51) Int. Cl.

| | |
|---|---|
| ***H01Q 9/04*** | (2006.01) |
| ***H01Q 13/10*** | (2006.01) |
| ***H01Q 21/24*** | (2006.01) |
| ***H01Q 21/28*** | (2006.01) |

(52) U.S. Cl.
CPC ..... *H01Q 13/10* (2013.01); *H01Q 21/24* (2013.01); *H01Q 21/28* (2013.01)

(58) Field of Classification Search
USPC ..... 343/702
See application file for complete search history.

(56) References Cited

U.S. PATENT DOCUMENTS

| | | | | |
|---|---|---|---|---|
| 10,516,201 | B2 * | 12/2019 | Khripkov | H01Q 13/106 |
| 10,644,382 | B2 * | 5/2020 | Lee | H01Q 9/42 |
| 2005/0254759 | A1 * | 11/2005 | O'Brien | G02B 6/4248 385/92 |
| 2010/0073247 | A1 | 3/2010 | Arkko et al. | |
| 2012/0200464 | A1 | 8/2012 | Nielsen et al. | |
| 2013/0147664 | A1 * | 6/2013 | Lin | H01Q 13/085 342/372 |
| 2014/0354487 | A1 | 12/2014 | Liang et al. | |
| 2015/0116169 | A1 | 4/2015 | Ying | |
| 2016/0088131 | A1 | 3/2016 | Chiu | |
| 2016/0118713 | A1 | 4/2016 | Hong et al. | |
| 2016/0157033 | A1 | 6/2016 | Won et al. | |
| 2016/0211586 | A1 | 7/2016 | Hong et al. | |
| 2016/0336646 | A1 | 11/2016 | Baek et al. | |
| 2017/0033445 | A1 | 2/2017 | Okajima et al. | |
| 2017/0040667 | A1 | 2/2017 | Lee | |
| 2017/0294705 | A1 * | 10/2017 | Khripkov | H01Q 21/24 |
| 2018/0358699 | A1 * | 12/2018 | Li | H01Q 11/14 |

FOREIGN PATENT DOCUMENTS

| | | | |
|---|---|---|---|
| CN | 106410370 | A | 2/2017 |
| CN | 106450680 | A | 2/2017 |
| JP | 2003318622 | A | 11/2003 |
| KR | 20100005071 | A | 1/2010 |
| KR | 20120137770 | A | 12/2012 |
| KR | 20160064842 | A | 6/2016 |
| TW | 201445810 | A | 12/2014 |
| WO | 2013090456 | A1 | 6/2013 |
| WO | 2015166800 | A1 | 11/2015 |

OTHER PUBLICATIONS

Foreign Communication From a Counterpart Application, PCT Application No. PCT/EP2017/061429, International Search Report dated Jan. 31, 2018, 6 pages.

Foreign Communication From a Counterpart Application, PCT Application No. PCT/EP2017/061429, Written Opinion dated Jan. 31, 2018, 7 pages.

* cited by examiner

COMMUNICATION DEVICE

CROSS-REFERENCE TO RELATED APPLICATION

This application is a national stage of International Application No. PCT/EP2017/061429, filed on May 12, 2017, which is hereby incorporated by reference in its entirety.

TECHNICAL FIELD

The invention relates to a communication device for wireless communication.

BACKGROUND

Communication devices, such as e.g. mobile phones, need to support more and more different radio technologies. These radio technologies may include cellular radio technologies, such as 2G/3G/4G radio, as well as non-cellular radio technologies. Conventionally, each radio technology requires a dedicated antenna transmitting and receiving radio signals. Designing separate antennas for every radio technology makes the design of communication devices very challenging, e.g. due to space limitations in communication devices. In addition, placing many antennas near each other can lead to serious antenna coupling problems.

In the coming 5G radio technology, the used frequency range will be expanded from below 6 GHz, also known as sub-6 GHz, to 60 GHz, also known as millimetre Wave (mmWave) frequencies. Hence, more antennas will be needed to support all the required frequency bands. For mmWave frequencies, the radio application requires the use of an array of multiple antenna elements. The antenna array is integrated into a module together with a radio frequency integrated circuit (RFIC) and baseband (BB) processors so as to form a mmWave antenna. Conventional designs require a separated mmWave antenna which needs to be implemented in the communication device. Hence, the conventional sub-6 GHz antenna and the mmWave antenna each occupy their own space in the communication device and need to be co-located in the communication device. This leads to challenges related to utilization of space within the communication device, as well as electromagnetic compatibility issues between the two types of antennas. Furthermore, typically mmWave antennas are not compatible with the metal backsurface which typically covers a conventional communication device.

Consequently, the introduction of new radio technology, such as 5G, leads to challenges in the antenna design of future communication devices.

SUMMARY

An objective of embodiments of the invention is to provide a solution which mitigates or solves the drawbacks and problems of conventional solutions.

The above and further objectives are solved by the subject matter of the independent claims. Further advantageous implementation forms of the present invention can be found in the dependent claims.

According to a first aspect of the invention, the above mentioned and other objectives are achieved with a communication device for wireless communication, the communication device comprising:

a housing comprising a front dielectric cover, a back dielectric cover and a metal frame circumferentially arranged between the front dielectric cover and the back dielectric cover, wherein the metal frame forms a first antenna configured to radiate in a first set of frequency bands;

a circuit arranged inside the housing, wherein the circuit is electrically isolated from the metal frame and comprises at least one first feed line coupled to the metal frame and configured to feed the first antenna with a first set of radio frequency signals in the first set of frequency bands;

a second antenna arranged inside the housing, wherein the second antenna comprises one or more radiating elements configured to radiate in a second set of frequency bands through at least one aperture of the metal frame, wherein at least one frequency band of the first set of frequency bands is non-overlapping with at least one frequency band of the second set of frequency bands.

It is therefore understood that the present communication device comprises one or more apertures through which the radiating elements of the second antenna radiate. An aperture may in one example form a through hole or a slot in the metal frame. The through hole or slot may be filled with a dielectric material having suitable impedance matching properties. The through hole or slot may take many different shapes, such as a cross, a rectangle, a square, a circle, etc.

A set of frequency bands in this disclosure should be understood to comprise one or more frequency bands. In addition, the meaning that a frequency band is non-overlapping with another frequency band should be understood to mean that the two frequency bands do not have any frequencies in common.

A communication device according to the first aspect provides a number of advantages over conventional solutions. One advantage is that the design of the first antenna and the second antenna in the communication device enables efficient use of the limited space in the communication device.

The communication device according to the first aspect further avoids antenna coupling problems which arises when two separate antennas are placed near each other.

Furthermore, in case of a handheld device the performance of the first antenna in free-space and in beside head and hand positions are maximized by the arrangement of the metal frame. By the first antenna be formed by the metal frame, the first antenna can utilize the entire top and/or bottom side and corners for the best coupling to chassis mode, thus creating the optimum environment for the best radiation.

Moreover, the second antenna gain and beam scan coverage are maximized by the arrangement of the radiating elements of the second antenna within the first antenna volume.

In an implementation form of a communication device according to the first aspect, the one or more radiating elements of the second antenna are arranged adjacent to the circuit.

An advantage with this implementation form is that efficiency of the second antenna is maximized as the feed line length can be minimized. In addition, it allows the second antenna and corresponding circuits to be formed as a monolithically integrated antenna module thereby maximizing the mass-production yield.

In an implementation form of a communication device according to the first aspect, the one or more radiating elements of the second antenna are arranged at a board of the circuit.

An advantage with this implementation form is the compact design saving space. Therefore, e.g. the screen to phone ratio may be increased by arranging the second antenna as an integrated module within the board. A further advantage of this implementation form is that the radiating elements can be connected to the circuit as an independent module, separated from the rest of the parts/components of the communication device.

In an implementation form of a communication device according to the first aspect, the communication device comprises a first dielectric arranged inside the housing, wherein the first dielectric is configured to provide an electromagnetic coupling between the one or more radiating elements of the second antenna and the aperture.

An advantage with this implementation form is that the dielectric parts of the communication device and the conductive parts of the communication device are configured to support traveling wave propagation from antenna elements towards the free space. Direction of energy flow is generally along the surface of the communication device. Thus, radiation pattern of the second antenna is generally directed along the surface of the communication device. Thereby, the second antenna will have improved spatial coverage of beamforming and beam-scanning, providing high average gain over all spatial directions.

In an implementation form of a communication device according to the first aspect, the first dielectric is impedance matched for the one or more radiating elements of the second antenna.

An advantage with this implementation form is that reflections of electromagnetic waves are minimized, providing efficient multi-band operation of the second antenna by enhancing bandwidth of it's radiating elements.

In an implementation form of a communication device according to the first aspect, the first dielectric is arranged between the one or more radiating elements of the second antenna and the aperture.

Thereby, increased radiating characteristics towards the plane of the metal frame is provided.

In an implementation form of a communication device according to the first aspect, the one or more radiating elements of the second antenna are in galvanic contact with the metal frame at the aperture.

An advantage with this implementation form is that efficiency and frequency bandwidth of the second antenna are improved since the surface of the metal frame is utilized as a part of the second antenna radiating aperture, thus increasing the effective size of the second antenna.

In an implementation form of a communication device according to the first aspect, the one or more radiating elements of the second antenna are at least partially integrated within the metal frame so as to form a part of a radiating structure of the first antenna.

An advantage with this implementation form is that the second antenna gain and beam scan coverage are maximized by arranging the radiating elements of the second antenna within the metal frame of the communication device, which means at a minimum distance from the free-space outside the housing, thereby providing improved omni-coverage of the second antenna.

In an implementation form of a communication device according to the first aspect, the circuit comprises a second feed line connected to a radio frequency integrated circuit (RFIC) of the second antenna and configured to feed the RFIC with data, power and control signals.

An advantage with this implementation form is that the second antenna may be configured as a monolithically integrated module, connected to the circuit via the second feed line. Hence, the second antenna module can be standardized and hence cost-effectively mass-produced.

In an implementation form of a communication device according to the first aspect, the second feed line comprises a shielding connected to the metal frame, wherein the shielding is configured to ground the first antenna to a ground of the circuit.

An advantage with this implementation form is a simple and space saving solution to grounding of the first antenna.

In an implementation form of a communication device according to the first aspect, the communication device comprises a first dielectric arranged inside the housing and extending inwards in the housing in relation to the location of the second antenna.

An advantage with this implementation form is that the second antenna uses the volume inside the housing for impedance matching by means of the first dielectric located therein.

In an implementation form of a communication device according to the first aspect, the first dielectric is configured to provide an electromagnetic coupling between the one or more radiating elements of the second antenna and the front dielectric cover and the back dielectric cover, respectively.

An advantage with this implementation form is that the second antenna provides two-dimensional scanning beamforming in all spatial directions, end-fire (along the communication device), screen-side broadside (perpendicular to the screen of the communication device), and back-side broadside.

In an implementation form of a communication device according to the first aspect, the aperture is filled with a second dielectric.

An advantage with this implementation form is that the communication device is hermetically sealed and protected from environmental factors such as water, dust, mechanical stress, etc.

In an implementation form of a communication device according to the first aspect, the aperture comprises a plurality of slots arranged in a row.

An advantage with this implementation form is that said slots are coupling the radiating elements of the second antenna to free-space outside the housing, thereby providing impedance matching and improved beamforming properties.

In an implementation form of a communication device according to the first aspect, the plurality of slots comprises a first type of slots and a second type of slots alternately arranged in the row, wherein the first type of slots is configured for a first polarization and the second type of slots is configured for a second polarization orthogonal to the first polarization.

An advantage with this implementation form is that polarization diversity can be exploited by the second antenna. The polarization diversity is utilized for enabling MIMO performance and/or stable link communication in all directions of the communication device.

In an implementation form of a communication device according to the first aspect, the one or more radiating elements of the second antenna comprises a first array of radiating elements configured to radiate substantially in a first direction parallel to at least one of a surface of the front dielectric cover and a surface of the back dielectric cover; and a second array of radiating elements configured to radiate substantially in a second direction perpendicular to the first direction.

In an implementation form of a communication device according to the first aspect, the first array of radiating elements are end-fire radiating elements and the second array of radiating elements are broadside radiating elements.

An advantage with this implementation form is that constant beam-scanning array gain coverage in all directions within full solid angle is possible. Hence, wireless communication with other communication devices is maintained regardless of the orientation of the communication device orientation and user scenarios, (such as the user holding the phone in "talk position", "text typing position", "video position", etc.).

In an implementation form of a communication device according to the first aspect, the surface of the front dielectric cover is substantially parallel to the surface of the back dielectric cover.

In an implementation form of a communication device according to the first aspect, a surface of the metal frame is substantially perpendicular to at least one of the surface of the front dielectric cover and the surface of the back dielectric cover.

In an implementation form of a communication device according to the first aspect, the circuit is arranged on a board extending inside the housing in parallel to the first direction.

In an implementation form of a communication device according to the first aspect, all frequency bands of the first set of frequency bands are non-overlapping with all frequency bands of the second set of frequency bands.

In an implementation form of a communication device according to the first aspect, each frequency band of the first set of frequency bands is in the interval from 400 MHz to 10 GHz and each frequency band of the second set of frequency bands is in the interval from 10 GHz to 100 GHz.

An advantage with this implementation form is that the communication device e.g. supports:

Multiband MIMO 4×4 sub-6 GHz communication systems, such as: 2G, 3G, 4G LTE, WiFi 802.11a/b/g/n/ac; and mmWave communication systems, such as: 5G bands (24.25 GHz-43 GHz), 802.11ad WiGig (57 GHz-66 GHz).

Further applications and advantages of the present invention will be apparent from the following detailed description.

BRIEF DESCRIPTION OF THE DRAWINGS

The appended drawings are intended to clarify and explain different embodiments of the present invention, in which.

DETAILED DESCRIPTION

Figure 1A:
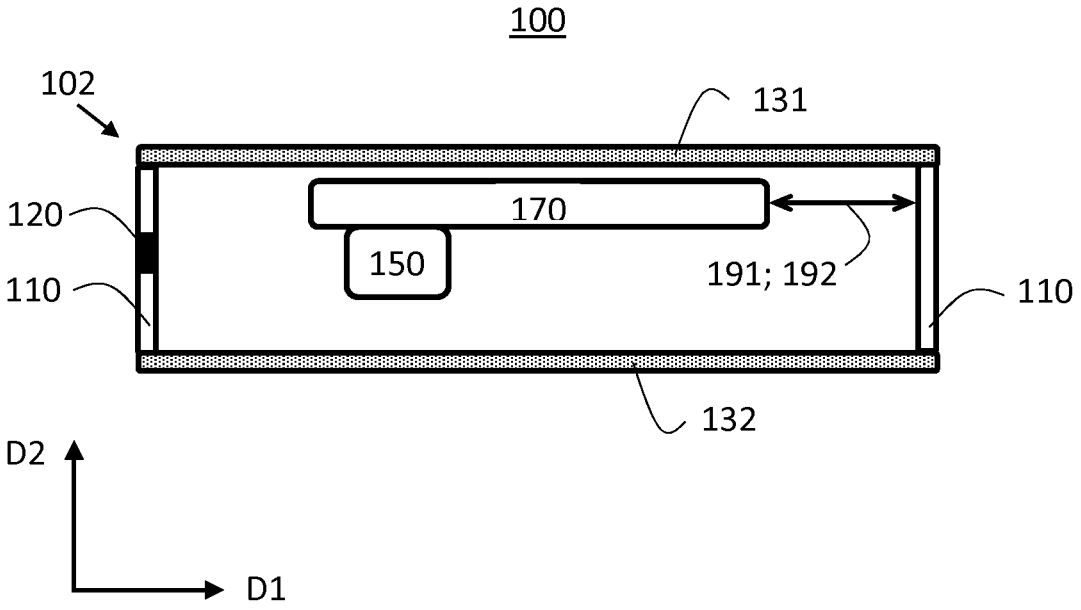
FIG. 1*a* shows a section of a communication device according to an embodiment of the invention.
Figure 1B:
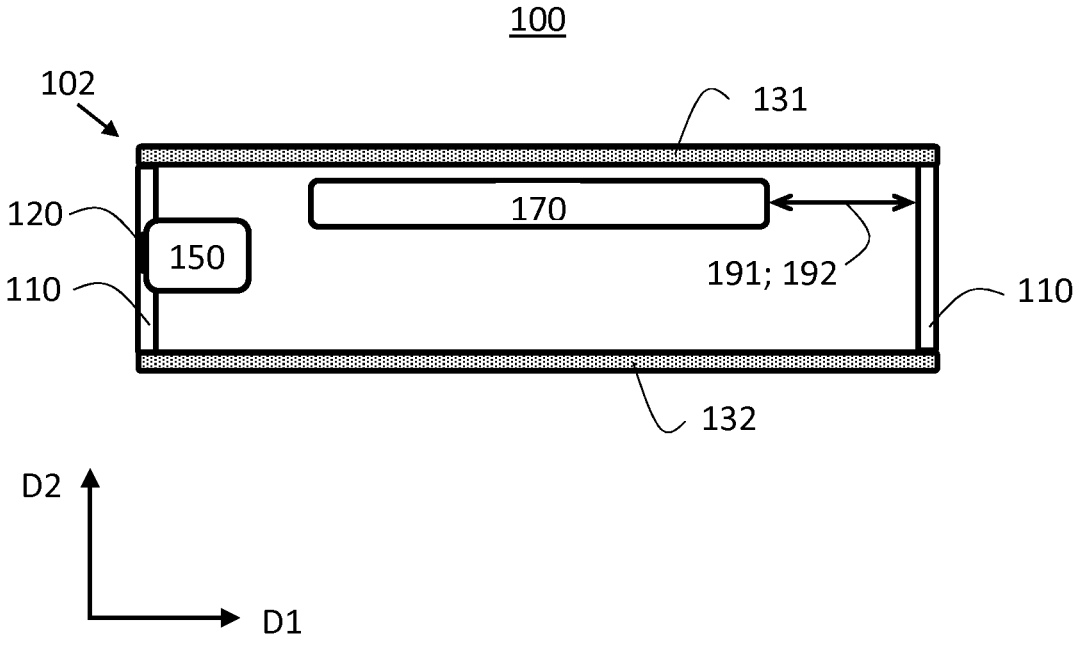
FIG. 1*b* shows a section of a communication device according to an embodiment of the invention.

FIGS. 1*a* and 1*b* show a section of a communication device 100 according to different embodiments of the invention. The communication device 100 comprises a housing 102 which comprises a front dielectric cover 131, a back dielectric cover 132, and a metal frame 110 circumferentially arranged between the front dielectric cover 131 and the back dielectric cover 132. The metal frame 110 may form a mechanical supporting structure between the front dielectric cover 131 and the back dielectric cover 132. In a preferred embodiment the metal frame is continuous, e.g. completely surrounds the components arrange inside the housing 102. In a further embodiment the metal frame 110 may be discontinuous in a direction surrounding the components arranged inside the housing 102, e.g. having non-metal areas (dielectric areas) in between.

The metal frame 110 further forms a first antenna configured to radiate in a first set of frequency bands FB1. The communication device 100 further comprises a circuit 170 arranged inside the housing 102. The circuit 170 is electrically isolated from the metal frame 110 and comprises at least one first feed line 191; 192 coupled to the metal frame 110 and configured to feed the first antenna with a first set of radio frequency signals in the first set of frequency bands FB1. Therefore, the metal frame 110 is configured to emit radio frequency signals of the first set of frequency bands FB1.

Furthermore, the communication device 100 comprises a second antenna 150 arranged inside the housing 102. The second antenna 150 comprises one or more radiating elements 330; 340 (shown in e.g. FIGS. 3 and 7) which are configured to radiate in a second set of frequency bands FB2 through at least one aperture 120 of the metal frame 110. At least one frequency band of the first set of frequency bands FB1 is non-overlapping with at least one frequency band of the second set of frequency bands FB2.

In embodiments of the communication device 100 according to the invention all frequency bands of the first set of frequency bands FB1 are non-overlapping with all frequency bands of the second set of frequency bands FB2. Hence, the first antenna and the second antenna 150 have no frequency bands in common and will radiate in different frequency bands. In one such embodiment, each frequency band of the first set of frequency bands FB1 is in the interval from 400 MHz to 10 GHz and each frequency band of the second set of frequency bands FB2 is in the interval from 10 GHz to 100 GHz. Therefore, the first antenna may support a first radio technology such as LTE whilst the second antenna 150 may support another radio technology, such as 5G new radio (NR). Also, other combinations of radio communication technologies are possible.

The second antenna 150 may be arranged inside the housing 102 either separated from the metal frame 110 or fully or partially integrated with the metal frame 110, as shown in the two different embodiments in FIGS. 1*a* and 1*b*, respectively. In the embodiment shown in FIG. 1*a*, the second antenna 150 is arranged electrically separated from the metal frame 110 and adjacent to the circuit 170. In this embodiment, the electromagnetic coupling of the second antenna 150 to the aperture 120 of the metal frame 110 is configured using dielectric structures. In the embodiment shown in FIG. 1*b*, the second antenna 150 is instead arranged adjacent to, partially or fully integrated with the metal frame 110. In this embodiment, the electromagnetic coupling of the second antenna 150 to the aperture 120 of the metal frame 110 is configured using conductive structures.

FIGS. 1*a* and 1*b* shows the relative location between the different parts/components of the communication device 100. In the embodiments shown in FIGS. 1*a* and 1*b* the surface of the front dielectric cover 131 and the surface of the back dielectric cover 132 are both extending in a first direction D1. Thus, the surface of the front dielectric cover 131 is substantially parallel to the surface of the back dielectric cover 132. A (main) surface of the metal frame 110 is extending in a second direction D2, which is perpendicular to the first direction D1 Thus, the surface of the metal frame 110 is substantially perpendicular to at least one of the surface of the front dielectric cover 131 and the surface of the back dielectric cover 132. The dielectric cover 131, the back dielectric cover 132, and the metal frame 110 may thereby in one case form an approximately rectangular shaped box, where the dielectric cover 131 and the back dielectric cover 132 constitute the top and bottom of the rectangular box, respectively, and the metal frame 110 constitute the sides of the rectangular box (e.g. as supporting side walls of the housing 102).

The circuit 170 may be arranged on a PCB board 230 (shown in FIG. 5) extending inside the housing 102 parallel to at least one of the surface of the front dielectric cover 131 and the surface of the back dielectric cover 132, i.e. extending in the first direction D1. In another embodiment, the relative location between the parts of the communication device 100 may differ from the relative locations shown in FIGS. 1*a* and 1*b* without deviating from the scope of the invention.

Feeding, grounding and impedance loading of the first antenna may be provided with one or more connection points 191; 192 arranged between the circuit 170 and the metal frame 110. The metal frame 110 is acting as emitter of the first antenna while the circuit 170 is acting as or does provide a ground for the first antenna. The first antenna may support N×N (where N is a positive integer) Multiple Input Multiple Output (MIMO) transmissions operating at multiple cellular frequency bands, e.g. from 698 MHz to 5800 MHz. Such MIMO antenna may operate at overlapping frequency bands, enabling carrier aggregation support, e.g. in LTE and LTE advanced. In embodiments, the first antenna may include monopole antennas, slot antennas, inverted-F antennas, multi-feed antennas, T-shape antennas, antennas with capacitive or with inductive feeding, antennas with capacitive or with inductive impedance loading, antennas with tunable impedance loading and all their derivatives. The first antenna may further be configured to effectively radiate electromagnetic energy at multiple cellular frequency bands, e.g. from 698 MHz to 5800 MHz. The first antenna may further be configured to have mutual isolation better than 10 dB within said frequency bands and envelope correlation coefficient (ECC) which is less than 0.2.

Figure 2:
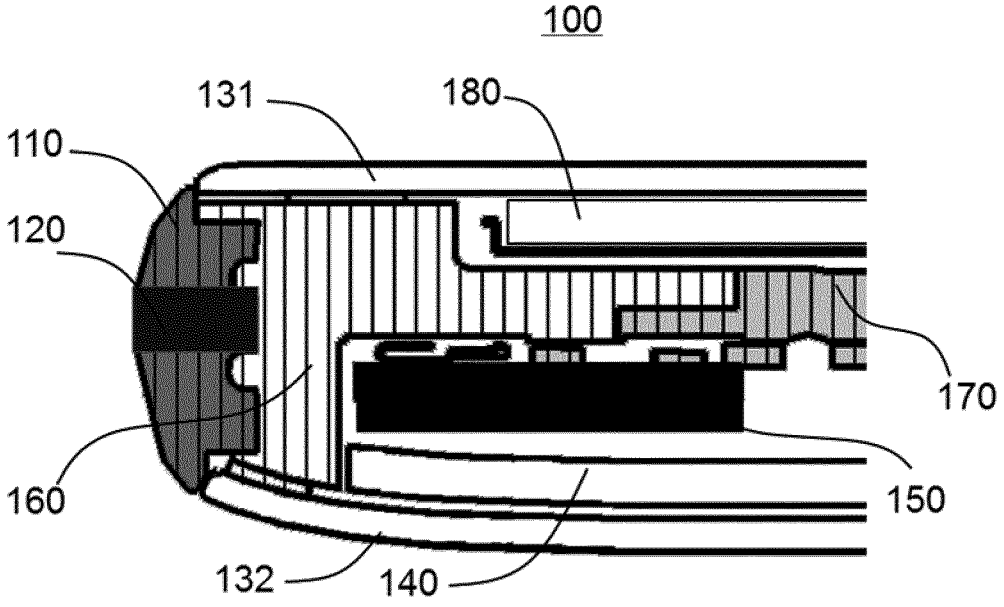
FIG. 2 shows a cross-section of a communication device according to an embodiment of the invention.

FIG. 2 shows an embodiment of the communication device 100 where dielectric structures are used to provide electromagnetic coupling of the second antenna 150 to the at least one aperture 120 of the metal frame 110. In FIG. 2 the communication device 100 further comprises a first dielectric 160 arranged inside the housing 102, and configured to separate the second antenna 150 from the metal frame 110. The first dielectric 160 is configured to electromagnetic couple the one or more radiating elements 330; 340 of the second antenna 150 to the aperture 120 in the metal frame 110. Hence, the first dielectric 160 is arranged between the one or more radiating elements 330; 340 of the second antenna 150 and the aperture 120 as shown in FIG. 2. In addition, the first dielectric 160 may be impedance matched for the one or more radiating elements 330; 340 of the second antenna 150. Thereby, providing spatial impedance matching of the electromagnetic energy propagating through the first dielectric 160 from the one or more radiating elements 330; 340 of the second antenna 150.

The first dielectric 160 may be a composition of polyamides-glass fiber (GF), polycarbonate (PC)-GF, polycarbonate (PC)-acrylonitrile butadiene styrene (ABS), polybutylene terephthalate (PBT)-GF, or similar materials. The first dielectric 160 may be formed via nano-molding technology generally based on GF-reinforced compositions. Alternatively, the first dielectric 160 may be formed as injection molded part based on resins such as Polyphenylene ether (PPE), PC, Polypropylene (PP), Polyethylene (PE) and Polyphenylene sulphide (PPS).

Properties of other parts of the communication device 100 shown in FIG. 2, such as front dielectric cover 131, back dielectric cover 132, dielectric filling 140 under the back dielectric cover 132, and screen 180, are configured to maximize performance of the second antenna 150.

In the embodiment shown in FIG. 2 the second antenna 150 is positioned substantially perpendicularly to the metal frame 110, and substantially parallel to the screen 180. The aperture 120 is formed within the metal frame 110 substantially in front of the second antenna 150. Thereby, the aperture 120 couples the second antenna 150 with free space outside the housing 102, providing impedance matching of the electromagnetic energy as it propagates from the one or more radiating elements 330; 340 of the second antenna 150 towards a surface of the communication device 100. In order to provide good electromagnetic coupling between the one or more radiating elements 330; 340 of the second antenna 150 and the aperture 120, the second antenna 150 and the aperture 120 should be horizontally aligned. However, this is not always possible due to design considerations of the communication device 100.

Figure 4:
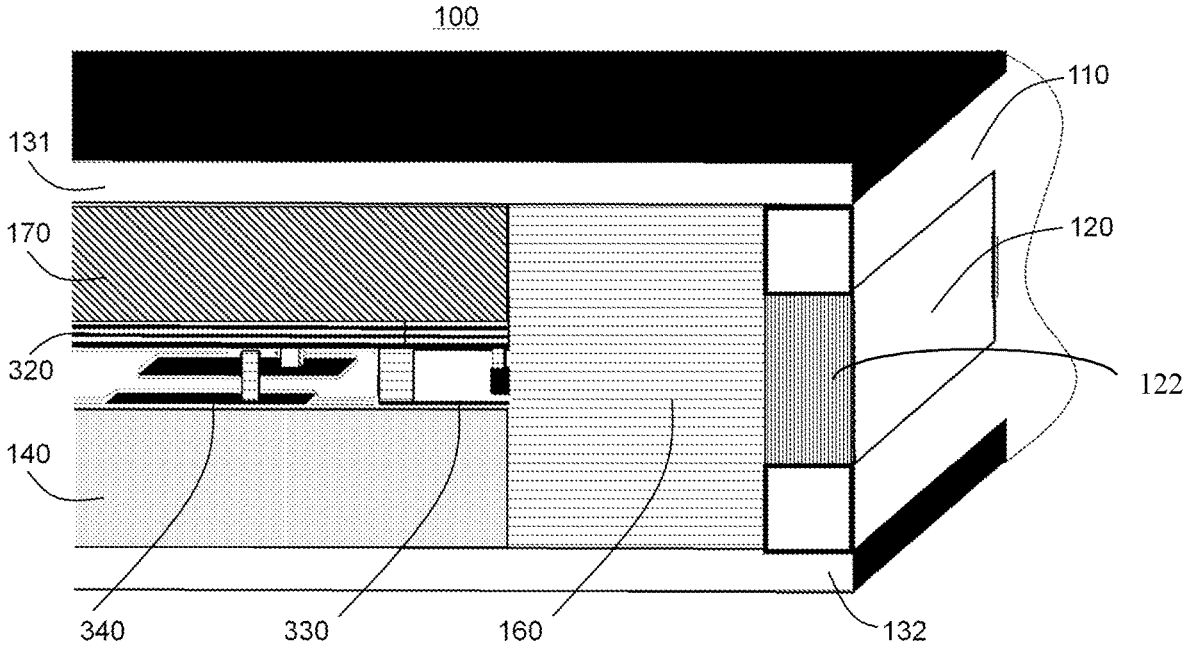
FIG. 4 shows a cross-section of a communication device according to an embodiment of the invention.

In some embodiments, the aperture 120 is filled with a second dielectric 122 (shown in FIG. 4). The second dielectric 122 may comprise the same dielectric material as the first dielectric 160 or a different dielectric material. Examples of dielectrics that may be used are compositions of polyamides-glass fiber (GF), polycarbonate (PC)-GF, polycarbonate (PC)-acrylonitrile butadiene styrene (ABS), polybutylene terephthalate (PBT)-GF, or similar materials. The second dielectric 122 may be formed via nano-molding technology generally based on GF-reinforced compositions. This means that the second dielectric 122 has high adhesion to the metal frame, high stiffness mechanical properties, as well as low dissipative energy loss. Alternatively, the second dielectric 122 may be formed as injection molded part based on resins such as Polyphenylene ether (PPE), PC, Polypropylene (PP), Polyethylene (PE) and Polyphenylene sulphide (PPS).

Figure 3:
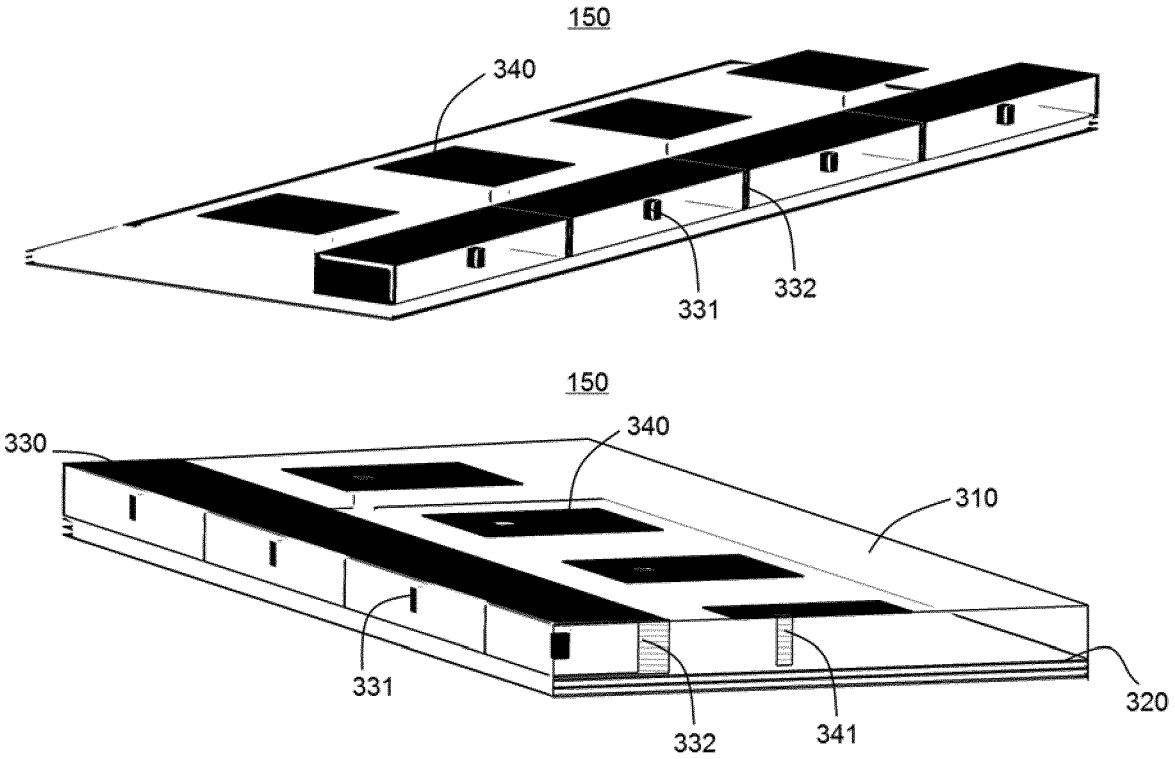
FIG. 3 shows a second antenna according to an embodiment of the invention.

FIG. 3 shows an embodiment of the second antenna 150. The second antenna 150 is in this embodiment based on a monolithically integrated module 310 comprising multiple conductive layers 320. Conductive patterns on conductive layers 320 and inter-conductive layers are configured to form sub arrays of radiating elements 330; 340, feedlines for those radiating elements, and assembly connection pads for the signal circuitry and related components. Feedlines and signal circuitry components are not shown in FIG. 3 for the sake of clarity. As shown in FIG. 3 the one or more radiating elements 330; 340 of the second antenna 150 may comprise a first array of radiating elements 330 and a second array of radiating elements 340. The first array of radiating elements 330 may be configured to radiate substantially in the first direction D1, shown in FIGS. 1*a* and 1*b*. The first direction D1 may be parallel to at least one of a surface of the front dielectric cover 131 and a surface of the back dielectric cover 132. Furthermore, the second array of radiating elements 340 may be configured to radiate substantially in the second direction D2, shown in FIGS. 1*a* and 1*b*, perpendicular to the first direction D1. Hence, the second direction D2 may be perpendicular to at least one of a surface of the front dielectric cover 131 and a surface of the back dielectric cover 132.

In some embodiments, the first array of radiating elements 330 are end-fire radiating elements 330, e.g. waveguide antennas, slot antennas, monopole antennas, inverted-F antennas and their derivatives. Feeding of end-fire radiating elements 330 is provided using signal feedline vias 331, grounding is configured using multiple ground lines 332. The second array of radiating elements 340 are broadside radiating elements 340, e.g. single or dual-polarization patch antenna elements, stacked patches or their derivatives. Feeding of broadside radiating elements 340 is provided using signal feedline vias 341. Feedline vias are connection points to antenna elements, wherein the feedline vias are configured to match antenna impedance.

The radiating elements 330;340 may be monolithically integrated within the second antenna 150 and the number of radiating elements 330;340 within the second antenna 150 is implementation dependent. Any specific number of end-fire radiating elements 330 or broadside radiating elements 340, as well as their respective allocation topology, are within the scope of the invention. The second antenna 150 may be fabricated using Printed Circuit Board (PCB), low temperature co-fired ceramics (LTCC) or any other monolithic multilayer technologies, utilizing any dielectric materials. Also, the circuit 170 may be fabricated using PCB, LTCC or any other monolithic multilayer technologies, utilizing appropriate materials.

FIG. 4 shows a design of the second antenna 150 of the communication device 100 according to an embodiment. In FIG. 4 the one or more radiating elements 330; 340 of the second antenna 150 are arranged adjacent to the circuit 170. In some embodiments, the one or more radiating elements 330; 340 of the second antenna 150 are arranged at a board common to the circuit 170 and the second antenna 150, e.g. a PCB. In other embodiments, the one or more radiating elements 330; 340 of the second antenna 150 may instead be arranged on monolithically integrated substrates or fabricated using molded plastic with conductive parts etched on it.

FIG. 4 further shows the location of the second antenna 150 relatively to the aperture 120 of the metal frame 110 and the first dielectric 160 according to an embodiment. The first dielectric 160 is located between the metal frame 110 and the circuit 170 and provides clearance as required for efficient operation of the first antenna. In some embodiments, the width of the first dielectric 160 may vary within 1-5 mm.

The communication device 100 comprises dielectric parts and conductive parts which are configured to form the electromagnetic coupling of the second antenna 150 to the aperture 120 of the metal frame 110. The dielectric parts of the communication device 100 comprise e.g. the front dielectric cover 131 (e.g. front glass), the back dielectric cover 132 (e.g. back glass), the first dielectric 160 (e.g. insert molding parts), a dielectric filling 140 (e.g. plastic spacers), as well as ceramic inclusions and related dielectric parts. The conductive parts of the communication device 100 comprise, e.g. the circuit 170, the screen 180, metal frame 110, as well as PCB, shielding structures and mechanical metal structures and related conductive parts. The dielectric parts of the communication device 100, and the conductive parts of the communication device 100 are configured to support traveling wave propagation from antenna elements towards the free space. Thereby, reflections of electromagnetic waves at structure discontinuities are minimized hence providing better radiating characteristics. Direction of the energy flow is generally along the surface of the communication device 100, typically along the surface of the front dielectric cover 131 and/or the surface of the back dielectric cover 132. Thus, radiation pattern of the second antenna 150 is generally directed along the surface of the communication device 100.

In some embodiments, the radiating elements 330; 340 of the second antenna 150 are configured as traveling wave antennas with phase velocity of the traveling wave $v_1$. The traveling wave antennas may be either slow wave structures or fast wave structures.

When slow wave structures of the traveling wave antennas are used, beamforming in second antenna 150 is configured to radiate along the communication device 100, sometimes called end-fire direction. Thus, the metal frame 110 structure, the dielectric parts of the communication device 100, and the conductive parts of the communication device 100 form a slow wave structure having phase velocity of the traveling wave equal to or less than the speed of light in free space, i.e.:

$$\frac{v_1}{c} < 1;$$

c=300,000 km/sec. Radiation into free space is performed at outer surfaces of the dielectric parts of the communication device 100, and the conductive parts of the communication device 100, i.e. at discontinuities, curvatures and nonuniformities of said parts. Therefore, frequency bands and beamforming properties are defined by geometrical parameters of the structures shown in FIG. 4.

When fast wave structures of the traveling wave antennas are used, beamforming in second antenna 150 is configured to radiate at an angle to the surface of the front dielectric cover 131 and/or the surface of the back dielectric cover 132 or generally perpendicular to the surface of the front dielectric cover 131 and/or the surface of the back dielectric cover 132, sometimes called broad-side directions. Thus, the metal frame 110 structure, the dielectric parts of the communication device 100, and the conductive parts of the communication device 100 form fast wave structures having phase velocity of the traveling wave higher than the speed of light in free space, i.e.:

$$\sin\theta_1 = \frac{v_1}{c},$$

The metal frame 100 structure, the dielectric parts of the communication device 100, and the conductive parts of the communication device 100 are configured so that the second antenna 150 is radiating electromagnetic waves into free space in small increments per unit length along the surface of the aperture 120 in the metal frame 110, the surface of the front dielectric cover 131, or the surface of the back dielectric cover 132. As the electromagnetic wave travels along the communication device 100 structures from the PCB-based coupling elements towards free-space, it leaks electromagnetic energy throughout the dielectric filled aperture 120. The beam radiation angle $\theta_1$ from normal direction is defined as $$\frac{v_1}{c} > 1.$$

indicating the angle where the maximum of the major lobe occurs. Therefore, the frequency bands and beamforming properties are defined by dielectric properties of the metal frame 110 structures, the dielectric parts of the communication device 100, and the conductive parts of the communication device 100.

Figure 5:
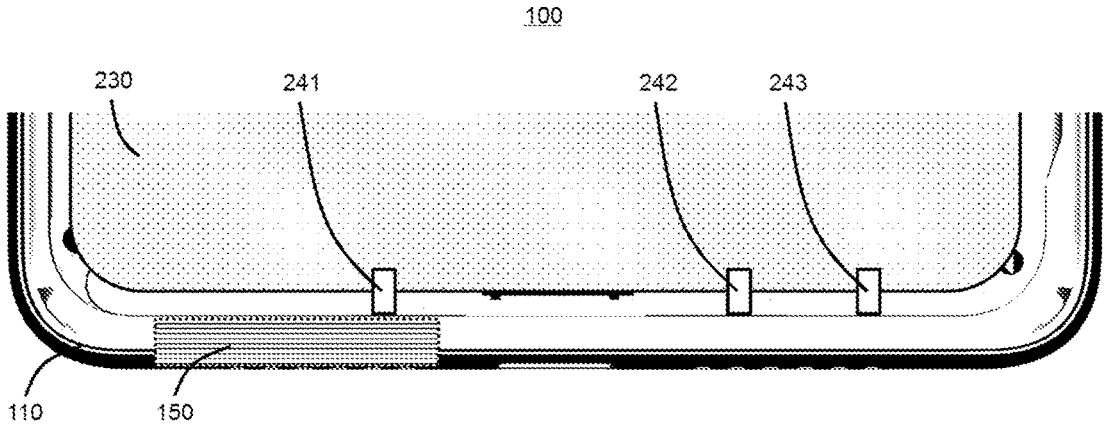
FIG. 5 shows a section of a communication device according to an embodiment of the invention.

FIG. 5 shows an embodiment of the communication device 100 where conductive structures are used to provide electromagnetic coupling of the second antenna 150 to the metal frame 110. In FIG. 5 the one or more radiating elements 330; 340 of the second antenna 150 are in galvanic contact with the metal frame 110 at the aperture 120. As shown in FIG. 5 the one or more radiating elements 330; 340 of the second antenna 150 may at least partially be integrated within the metal frame 110 so as to form a part of a radiating structure of the first antenna. FIG. 5 further shows a PCB board 230. The gap between the PCB board 230 and the metal frame 110 is configured to radiate at the first set of frequency bands FB1. Second feedlines 241, 242, 243 are connecting the circuit 170 on the PCB board 230 with the metal frame 110.

Figure 6:
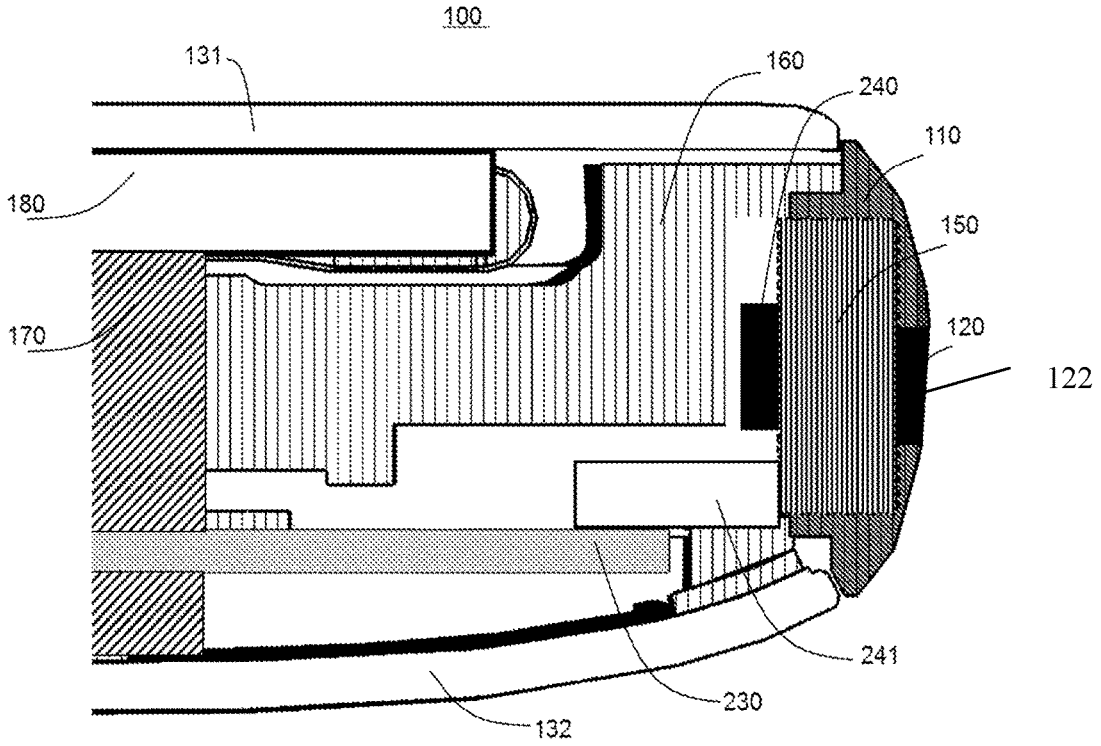
FIG. 6 shows a cross-section of a communication device according to an embodiment of the invention.

FIG. 6 shows the location of the second antenna 150 within the metal frame 110 according to an embodiment where the second antenna 150 is in galvanic contact with the metal frame 110. The aperture 120 of the metal frame 110 may be filled with a second dielectric 122. The second dielectric 122 may comprise the same dielectric material as the first dielectric 160 or a different dielectric material as previously stated. The second dielectric 122 may be fabricated using insert molding or any of suitable other techniques.

The second antenna 150 may be affixed in proximity to the aperture 120. In the embodiment shown in FIG. 6, the second antenna 150 is located substantially parallel to the surface of metal frame 110, and substantially perpendicularly to the screen 180. A radio frequency integrated circuit (RFIC) 240 is affixed to the second antenna 150, at opposite side from the aperture 120. In some embodiments, the second antenna 150 utilizes flip-chip connection of the RFIC 240, wire-bonding, packaging with ball grid array (BGA) or relevant techniques.

According to embodiments the circuit 170 may comprises a second feed line 241. The second feed line 241 may be connected to the RFIC 240 of the second antenna 150 and configured to feed the RFCI 240 with data, power and control signals. Furthermore, the second feed line 241 may also comprise a shielding connected to the metal frame 110, wherein the shielding is configured to ground the first antenna to a ground of the circuit 170. Hence, the second feed line 241 works as ground for the first antenna, as well as signal source for the second antenna 150. This embodiment provides minimum volume required for the first antenna and the second antenna 150. Antenna volume is effectively reused for radiation at all frequency bands, including the second set of frequency bands FB2.

In some embodiments, the thickness of the metal frame 110 with the second antenna 150 is below 1.5 mm and the thickness of the second antenna 150 is below 1 mm.

The communication device 100 according to the embodiment shown in FIG. 6 comprises a first dielectric 160 arranged inside the housing 102 and extending inwards in the housing 102 in relation to the location of the second antenna 150. The first dielectric 160 is configured to electromagnetic couple the one or more radiating elements 330; 340 of the second antenna 150 to the front dielectric cover 131 and the back dielectric cover 132, respectively. In embodiments, the first dielectric 160 is arranged between the one or more radiating elements 330; 340 of the second antenna 150 and the front dielectric cover 131 and the back dielectric cover 132, respectively. The first dielectric 160 may fully or partially fill the space (due to considerations at assembly) between the one or more radiating elements 330; 340 of the second antenna 150 and the front dielectric cover 131 and the back dielectric cover 132.

Figure 7:
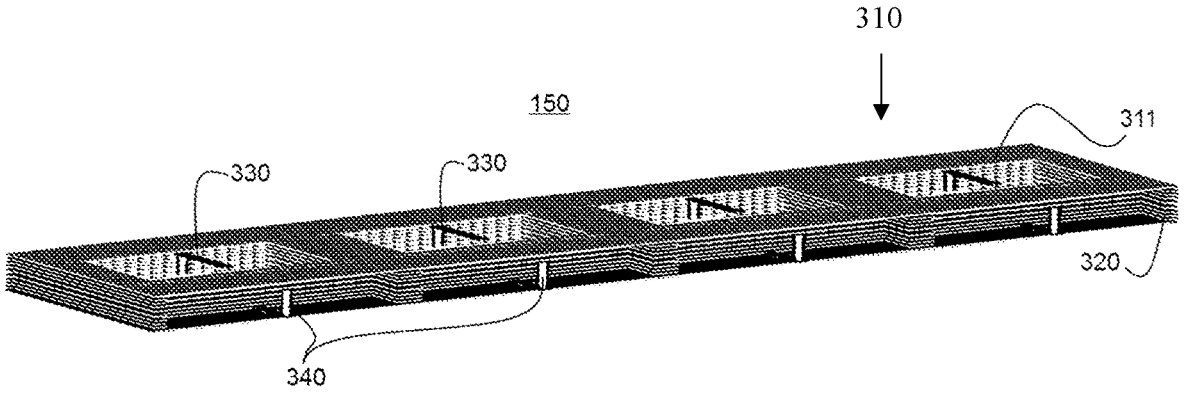
FIG. 7 shows a second antenna according to an embodiment of the invention.

FIG. 7 shows an embodiment of the second antenna 150. The second antenna 150 is in this embodiment based on a monolithically integrated module 310, comprising multiple conductive layers 320. Conductive patterns on the conductive layers 320 and inter-layer conductive are configured to form sub arrays of radiating elements 330; 340, feedlines for those radiating elements, and assembly connection pads for signal circuitry and related components. Feedlines and signal circuitry components are not shown in FIG. 7 for the sake of clarity. The RFIC 240 of the second antenna 150 is feeding sub arrays of radiating elements 330; 340 of the second antenna 150, which are configured to excite electromagnetic field through the aperture 120. Thus, electromagnetic radiation into free-space is performed through the aperture 120 of the metal frame 110. Galvanic contact is provided between the metal frame 110 and the second antenna 150 at the surface 311, which is assuring electromagnetic coupling for operation at the second set of frequency bands FB2. As shown in FIG. 7, the one or more radiating elements 330; 340 of the second antenna 150 may comprise a first array of radiating elements 330 and a second array of radiating elements 340. The first array of radiating elements 330 may be configured to radiate substantially in the first direction D1, shown in FIGS. 1*a* and 1*b*. The first direction D1 may be parallel to at least one of a surface of the front dielectric cover 131 and a surface of the back dielectric cover 132. Furthermore, the second array of radiating elements 340 may be configured to radiate substantially in the second direction D2, shown in FIGS. 1*a* and 1*b*, perpendicular to the first direction D1. Hence, the second direction D2 may be perpendicular to at least one of a surface of the front dielectric cover 131 and a surface of the back dielectric cover 132.

Figure 8:
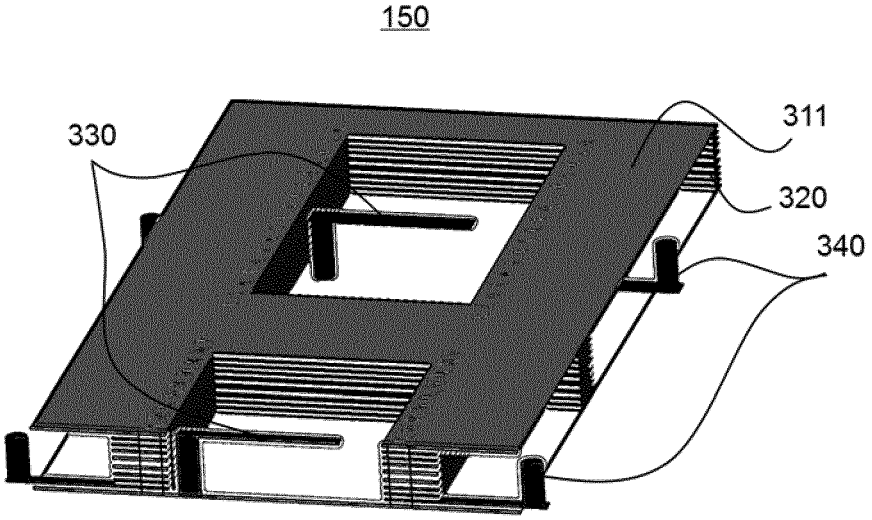
FIG. 8 shows a section of a second antenna according to an embodiment of the invention.

FIG. 8 shows a cross-section of the second antenna 150. In the embodiment shown in FIG. 8, the first array of radiating elements 330 are end-fire radiating elements 330, e.g. waveguide antennas, slot antennas, monopole antennas, inverted-F antennas and all their derivatives. End-fire radiating elements 330 are utilizing the contact surface 311 for electromagnetic coupling with the aperture 120 of the metal frame 110. In this case, beamforming is substantially in the end-fire direction, along the communication device 100. The second array of radiating elements 340 are broadside radiating elements 340, e.g. single or dual-polarization dipole antenna elements, slot antennas, waveguide antennas and their derivatives. Broadside radiating elements 340 are exciting currents on the metal frame 110 and adjacent metal parts, such as screen, internal conductive structures and surfaces of related components. In this case, an air gap between the PCB of the circuit 170 and the metal frame 110 form a part of the beamforming structure of the communication device 100.

The radiating elements 330; 340 may be monolithically integrated within the second antenna 150 and the number of radiating elements 330; 340 within the second antenna 150 is implementation dependent. Any specific number of end-fire radiating elements 330 or broadside radiating elements 340, as well as their respective allocation topology, are within the scope of the invention.

Figure 9:
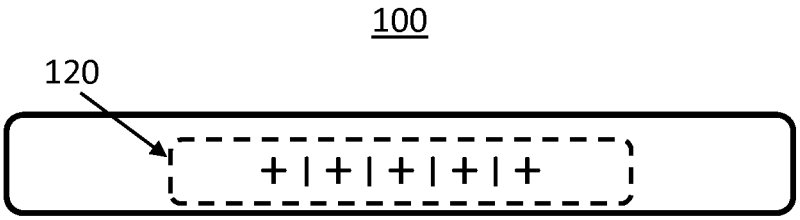
FIG. 9 illustrates slots of the at least one aperture according to an embodiment of the invention.

FIG. 9 shows an embodiment of the communication device 100 where the at least one aperture 120 comprises a plurality of slots arranged in a row. In the embodiment shown in FIG. 9 the plurality of slots comprises a first type of slots and a second type of slots alternately arranged in the row. The first type of slots is configured for a first polarization and the second type of slots is configured for a second polarization orthogonal to the first polarization. This means that signals of the first polarization can only radiate through slots of the first type. In the same way, signals of the second polarization can only radiate through slots of the second type.

The embodiment shown in FIG. 9 may be used when the end-fire radiating elements 330 of the second antenna 150 are arranged to radiate with two different polarizations, a vertical (V) polarization and a horizontal (H) polarization, respectively. End-fire radiating elements 330 of the second antenna 150 configured to radiate in the vertical polarization are alternatingly arranged with end-fire radiating elements 330 of the second antenna 150 configured to radiate in the horizontal polarization. Hence, the aperture 120 should comprise slots shaped differently for vertical polarization and second polarization. Furthermore, the slots should be alternatingly arranged to correspond to the polarization of the end-fire radiating elements 330 of the second antenna 150 such as having a VHVHVHVH pattern.

Beamforming characteristics of the second antenna 150 is herein explained for the embodiments using dielectric structures for electromagnetic coupling of the second antenna 150 to the at least one aperture 120. End-fire radiating elements 330 are emitting electromagnetic energy towards the metal frame 110, and the aperture 120 is configured to effectively couple that electromagnetic energy into free space which leads to beamforming in the horizontal direction. Broadside radiating elements 340 are emitting electromagnetic energy towards the dielectric filling 140 under the back dielectric cover 132 and substantially beamforming in the vertical direction. Phase-adjustment for signals fed to end-fire radiating elements 330 relatively to signals fed to broadside radiating elements 340 results in beam tilting in the vertical plane for any arbitrary angle. Phase control for neighboring elements within the first array of end-fire radiating elements 330 and within the second array of broadside radiating elements 340 enables beam tilting in the horizontal plane (i.e. along the metal frame 110 line).

Beamforming characteristics of the second antenna 150 is herein explained for the embodiments using conductive structures for electromagnetic coupling of the second antenna 150 to the at least one aperture 120. Beamforming of the second antenna 150 is performed by phase-control and switching of different antenna elements. End-fire radiating elements 330 are utilizing the contact surface 411 for electromagnetic coupling with the aperture 120 of the metal frame 110. In this case, beamforming is generally directed in the end-fire direction along the communication device 100. Broadside radiating elements 340, e.g. single or dual-polarization dipole antenna elements, slot antennas, waveguide antennas and their derivatives. Broadside radiating elements 340 are exciting currents on the metal frame 110 and adjacent metal parts, such as a screen, internal conductive structures and surfaces of related components. In this case, an air-filled gap between the PCB of the circuit 170 and the metal frame 110 form part of the beamforming structure of the communication device 100. In embodiments, the second array of broadside radiating elements 340 are located at each side of the second antenna 150, as shown in FIG. 8. In this case, mmWave beamforming is covering both front side (screen side) of the communication device 100 and back side of the communication device 100. Phase control of signals fed to the second array of broadside radiating elements 340 and the first array of end-fire radiating elements 330 enables beam focusing towards any intermediate direction between different beams. Phase control for neighbouring elements within sub arrays 340 and within sub-arrays 330 enables beam tilting in the horizontal plane (along the metal frame 110 line).

The communication device 100 herein may e.g. be denoted as a user device, a User Equipment (UE), a mobile station, an internet of things (IoT) device, a sensor device, a wireless terminal and/or a mobile terminal, is enabled to communicate wirelessly in a wireless communication system, sometimes also referred to as a cellular radio system. The UEs may further be referred to as mobile telephones, cellular telephones, computer tablets or laptops with wireless capability. The UEs in the present context may be, for example, portable, pocket-storable, hand-held, computer-comprised, or vehicle-mounted mobile devices, enabled to communicate voice and/or data, via the radio access network, with another entity, such as another receiver or a server. The UE can be a Station (STA), which is any device that contains an IEEE 802.11-conformant Media Access Control (MAC) and Physical Layer (PHY) interface to the Wireless Medium (WM). The communication device 100 may also be configured for communication in 3GPP related LTE and LTE-Advanced, in WiMAX and its evolution, and in fifth generation wireless technologies, such as New Radio.

Moreover, it is realized by the skilled person that embodiments of the present communication device comprise the necessary communication capabilities in the form of e.g., functions, means, units, elements, etc., for performing the present solution. Examples of other such means, units, elements and functions are: processors, memory, buffers, control logic, encoders, decoders, rate matchers, de-rate matchers, mapping units, multipliers, decision units, selecting units, switches, interleavers, de-interleavers, modulators, demodulators, inputs, outputs, antennas, amplifiers, receiver units, transmitter units, DSPs, MSDs, TCM encoder, TCM decoder, power supply units, power feeders, communication interfaces, communication protocols, etc. which are suitably arranged together for performing the present solution.

Especially, the processor(s) of the communication device 100 may comprise, e.g., one or more instances of a Central Processing Unit (CPU), a processing unit, a processing circuit, a processor, an Application Specific Integrated Circuit (ASIC), a microprocessor, or other processing logic that may interpret and execute instructions. The expression "processor" may thus represent a processing circuitry comprising a plurality of processing circuits, such as, e.g., any, some or all of the ones mentioned above. The processing circuitry may further perform data processing functions for inputting, outputting, and processing of data comprising data buffering and device control functions, such as call processing control, user interface control, or the like.

Finally, it should be understood that the invention is not limited to the embodiments described above, but also relates to and incorporates all embodiments within the scope of the appended independent claims.

The invention claimed is:

1. A communication device for wireless communication, the communication device comprising:

a housing comprising:

a front dielectric cover;

a back dielectric cover; and a metal frame circumferentially arranged between the front dielectric cover and the back dielectric cover, wherein the metal frame defines a first antenna configured to radiate in a first set of frequency bands;

a circuit arranged inside the housing, wherein the circuit is electrically isolated from the metal frame and comprises a first feed line coupled to the metal frame, and wherein the circuit is configured to feed the first antenna with a first set of radio frequency signals in the first set of frequency bands; and a second antenna arranged inside the housing, wherein the second antenna comprises one or more radiating elements configured to radiate in a second set of frequency bands through an aperture of the metal frame, wherein a first frequency band of the first set of frequency bands is in a first interval from 400 megahertz (MHz) to 10 gigahertz (GHz), wherein a second frequency band of the second set of frequency bands is in a second interval from 10 GHz to 100 GHz, and wherein the one or more radiating elements comprise;

a first array of radiating elements configured to radiate substantially in a first direction parallel to at least one of a first surface of the front dielectric cover or a second surface of the back dielectric cover; and a second array of radiating elements configured to radiate substantially in a second direction perpendicular to the first direction, wherein the first array comprises end-fire radiating elements, and the second array comprises broadside radiating elements.

2. The communication device of claim 1, wherein the one or more radiating elements are arranged adjacent to the circuit.

3. The communication device of claim 2, further comprising a first dielectric arranged inside the housing, wherein the first dielectric is configured to provide an electromagnetic coupling between the one or more radiating elements and the aperture.

4. The communication device of claim 3, wherein the first dielectric is impedance matched for the one or more radiating elements.

5. The communication device of claim 3, wherein the first dielectric is arranged between the one or more radiating elements and the aperture.

6. The communication device of claim 1, wherein the one or more radiating elements are in galvanic contact with the metal frame at the aperture.

7. The communication device of claim 6, wherein the one or more radiating elements are partially integrated within the metal frame to form a part of a radiating structure of the first antenna.

8. The communication device of claim 7, wherein the circuit further comprises a second feed line coupled to a radio frequency integrated circuit (RFIC) of the second antenna and configured to feed the RFIC.

9. The communication device of claim 8, wherein the circuit further comprises a ground, wherein the second feed line comprises a shielding coupled to the metal frame, and wherein the shielding is configured to ground the first antenna to the ground.

10. The communication device of claim 6, further comprising a first dielectric arranged inside the housing and configured to extend inwards in the housing in relation to a location of the second antenna.

11. The communication device of claim 10, wherein the first dielectric is configured to provide a first electromagnetic coupling between the one or more radiating elements and the front dielectric cover and a second electromagnetic coupling between the one or more radiating elements and the back dielectric cover.

12. The communication device of claim 11, wherein the first dielectric is arranged between the one or more radiating elements and the front dielectric cover and between the one or more radiating elements and the back dielectric cover.

13. The communication device of claim 1, wherein the aperture is filled with a second dielectric.

14. The communication device of claim 1, wherein the aperture comprises a plurality of slots arranged in a row.

15. The communication device of claim 14, wherein the slots comprise a first type of slots and a second type of slots alternately arranged in the row, wherein the first type of slots is configured for a first polarization, and wherein the second type of slots is configured for a second polarization orthogonal to the first polarization.

16. The communication device of claim 1, wherein all frequency bands of the first set of frequency bands are non-overlapping with all frequency bands of the second set of frequency bands.

17. The communication device of claim 1, wherein each frequency band of the first set of frequency bands is in a first interval from 400 megahertz (MHz) to 10 gigahertz (GHz).

18. The communication device of claim 1, wherein each frequency band of the second set of frequency bands is in a second interval from 10 GHz to 100 GHz.

* * * * *